US010869525B2

(12) United States Patent
Miyazaki et al.

(10) Patent No.: US 10,869,525 B2
(45) Date of Patent: Dec. 22, 2020

(54) SLIDER FOR SLIDE FASTENER

(71) Applicant: YKK CORPORATION, Tokyo (JP)

(72) Inventors: Yohei Miyazaki, Kurobe (JP); Yoshikazu Hamada, Kurobe (JP)

(73) Assignee: YKK Corporation (JP)

( * ) Notice: Subject to any disclaimer, the term of this patent is extended or adjusted under 35 U.S.C. 154(b) by 0 days.

(21) Appl. No.: 16/631,088

(22) PCT Filed: Jul. 19, 2017

(86) PCT No.: PCT/JP2017/026140

§ 371 (c)(1),
(2) Date: Jan. 14, 2020

(87) PCT Pub. No.: WO2019/016900

PCT Pub. Date: Jan. 24, 2019

(65) Prior Publication Data

US 2020/0128926 A1 Apr. 30, 2020

(51) Int. Cl.
*A44B 19/30* (2006.01)

(52) U.S. Cl.
CPC ..... *A44B 19/303* (2013.01); *A44B 19/308* (2013.01)

(58) Field of Classification Search
CPC ... A44B 19/303; A44B 19/305; A44B 19/306; A44B 19/308
See application file for complete search history.

(56) References Cited

U.S. PATENT DOCUMENTS

| | | | |
|---|---|---|---|
| 2009/0094804 A1 | 4/2009 | Miyazaki et al. | |
| 2013/0174387 A1 | 7/2013 | Hamada | |

FOREIGN PATENT DOCUMENTS

| | | | |
|---|---|---|---|
| CN | 2506112 | 8/2002 | |
| CN | 102018335 | 9/2012 | |
| EP | 1762153 | 3/2007 | |
| EP | 1776889 | 4/2007 | |
| GB | 851767 A * | 10/1960 | ..... A44B 19/308 |
| JP | 4628227 | 2/2011 | |
| JP | 4632924 | 2/2011 | |

(Continued)

OTHER PUBLICATIONS

Miyazaki, Yohei; International Search Report and Written Opinion for PCT/JP2017/026140, filed Jul. 19, 2017, dated Oct. 10, 2017, 14 pgs.

(Continued)

*Primary Examiner* — Jack W Lavinder

(74) *Attorney, Agent, or Firm* — Taylor English Duma LLP

(57) ABSTRACT

A slider for a slide fastener includes a body, a pull-tab, a control claw, and a cover. The control claw is placed on a shaft portion between a front attachment column and a rear attachment column. A protrusion length of a claw portion that enters an element path from a claw hole changes depending on an up-down position of the shaft portion so as to control movement of the body. The cover is attached to the front attachment column and the rear attachment column so as to be swingable in an up-down direction. The upper plate portion pushes the control claw downward due to a restoring force of a plate spring portion extending from a front end of the upper plate portion along a front surface of the front attachment column. The body, the pull-tab, the control claw, and the cover are separate components.

5 Claims, 5 Drawing Sheets

(56) References Cited

FOREIGN PATENT DOCUMENTS

| | | |
|---|---|---|
| JP | 5008518 | 8/2012 |
| JP | 3206923 | 10/2016 |
| TW | 469779 | 12/2004 |
| WO | 2012042620 | 4/2012 |

OTHER PUBLICATIONS

YKK Corporation; Office Action for Taiwanese patent application No. 106136877, dated May 7, 2018, 8 pgs.

* cited by examiner

SLIDER FOR SLIDE FASTENER

TECHNICAL FIELD

The present disclosure relates to a slider for a slide fastener, and more specifically, to a slider having an automatic stop function.

RELATED ART

An example of a slider in a conventional art which has an automatic stop function consists of three components being: a body; a pull-tab which operates the body; and a cover which covers a portion of the pull-tab and attaches the pull-tab to the body in a rotatable manner (Patent Literature 1).

The cover includes an upper wall extending in a front-rear direction and a lateral wall extending downward from a lateral end of the upper wall. The cover includes an elastic piece serving as a plate spring extending downward from a front end of the upper wall, and a stop claw extending downward from a lower end of the lateral wall and serving as a control claw which controls the body to be movable and immovable.

The cover is attached to the body in a manner that is swingable vertically. More specifically, in the cover, a front portion of the lateral wall serves as a swing center portion while a rear portion of the lateral wall serves as a displacement portion that displaces (swings) vertically. When the pull-tab is operated to displace the rear portion of the cover upward, the elastic piece of the cover elastically deforms to generate a restoring force that pushes back the rear portion of the cover downward. When the rear portion of the cover is displaced upward, the stop claw is also displaced upward. When the pull-tab is released from a hand, the rear portion of the cover is automatically displaced downward due to the restoring force, and the stop claw deeply enters the inside of the body, so that the body is immovable with respect to a pair of element rows (stopped state). That is, the slider has the automatic stop function.

As another example of a slider in related conventional art which has the automatic stop function, a slider consists of five components being: a body; a pull-tab; a claw rod serving as a control claw which controls the body to be movable and immovable; a plate spring which generates a restoring force by elastic deformation to cause a portion of the claw rod to enter the inside of the body; and a cover which attaches the pull-tab, the plate spring and the claw rod to the body (Patent Literature 2).

CITATION LIST

Patent Literature

[Patent Literature 1] Japanese Patent No. 4628227
[Patent Literature 2] Japanese Patent No. 5008518

SUMMARY

Technical Problem

However, the cover of the slider disclosed in Patent Literature 1 includes the stop claw serving as the control claw as a portion of the cover. Therefore, rigidity of the control claw depends on thickness of the cover. Moreover, the cover is formed by press processing by bending. As a result, since the thickness of the cover has a dimension that is taken into consideration for ease of the press processing, it is difficult for the control claw to obtain desired rigidity. More specifically, the thickness of the cover becomes thin when considering the ease of the press processing, so the rigidity of the control claw tends to be lower than ideal.

The slider disclosed in Patent Literature 2 includes the control claw (claw rod), the plate spring and the cover as separate components, so the number of components is increased. In addition, since the claw rod, the plate spring and the cover are overlapped in an up-down direction in the slider, an up-down direction dimension of the slider tends to increase. In the slider, the cover is fixed to the body in a manner which is not swingable vertically with respect to the body, and the control claw is swung up and down inside the cover in accordance with the operation of the pull-tab. Therefore, an up-down direction dimension of the cover increases in accordance with a space portion in which the control claw swings vertically, and an up-down direction dimension of the slider is also increased in accordance with the up-down direction dimension of the cover.

The present disclosure has been made in view of the above circumstances, and an object thereof is to provide a slider in which the rigidity of the control claw can be made independent of the thickness of the cover, the number of components can be minimized, and the up-down direction dimension can be minimized.

Solution to Problem

A slider for a slide fastener according to the present disclosure includes: a body, in which an element path penetrating in a front-rear direction and a claw hole communicating upward with respect to the element path are formed, a front attachment column and a rear attachment column protruding from an upper surface of an upper wing plate covering an upper side of the element path; a pull-tab, which is rotatable in the front-rear direction, and in which a shaft portion serving as a center of the rotation is disposed on the upper wing plate; a control claw placed on the shaft portion between the front attachment column and the rear attachment column and configured to control the body to be movable and immovable, a protrusion length of a claw portion that enters the element path from the claw hole changing depending on an up-down position of the shaft portion, so as to control movement of the body; and a cover, having an upper plate portion and a lateral plate portion which cover the control claw from an upper side and a lateral side, and attached to the front attachment column and the rear attachment column so as to be swingable in an up-down direction, the upper plate portion pushing the control claw downward due to a restoring force of a plate spring portion extending from a front end of the upper plate portion along a front surface of the front attachment column. The body, the pull-tab, the control claw and the cover are separate components.

The following are examples of specific configurations of the control claw and the cover. That is, when the body is movable, the control claw and the cover are in contact with each other in the up-down direction.

The following is an example of a specific configuration of the lateral plate portion of the cover.

That is, the lateral plate portion of the cover includes a lateral plate body portion extending downward from left and right ends of the upper plate portion and a front protruding piece portion protruding forward with respect to a lower portion of the lateral plate body portion. In addition, the front protruding piece portion serves as a center portion when the cover swings.

Although it does not matter whether the control claw and the cover are in contact vertically when the body is immovable, the following is desirable for minimizing an up-down direction dimension of the slider.

That is, when the body is immovable, the control claw and the cover are in contact with each other in the up-down direction.

Although a relative relationship between heights of an upper surface of the cover and an upper surface of the front attachment column does not matter, the following is desirable for minimizing the up-down direction dimension of the slider.

That is, the plate spring portion includes a first spring piece portion extending forward from the front end of the upper plate portion, and a second spring piece portion extending downward from a front end of the first spring piece portion. In addition, a first recessed portion accommodating the first spring piece portion is provided in a center portion of the upper surface of the front attachment column in a left-right direction. The upper surface of the cover is at the same height as or lower than the upper surface of the front attachment column when the body is immovable.

Advantageous Effects

In the slider according to the present disclosure, since the control claw and the cover are separate components and a portion of the cover is formed as the plate spring portion, the number of components is smaller than that of the slider in which the control claw, the cover, and the plate spring are separate components (the slider disclosed in Patent Literature 2). In the slider in which the control claw, the cover, and the plate spring are separate components (the slider disclosed in Patent Literature 2), the up-down direction dimension is required to enable the cover and plate spring to overlap vertically. As for the slider according to the present disclosure, the plate spring portion, which is a portion of the cover, extends along the front surface of a front attachment column, so it is not necessary to overlap the plate spring as a separate component below the cover, and the up-down direction dimension can be reduced.

In the slider according to the present disclosure, the control claw and the cover are separate components, so the rigidity of the control claw and the thickness of the cover can be irrelevant as compared with the slider in which the control claw is a portion of the cover (the slider disclosed in Patent Literature 1).

The control claw and the cover may be in contact with each other vertically when the body is immovable, thereby the slider can have a smaller dimension in the up-down direction.

The upper surface of the cover may be at the same height or lower than the upper surface of the front attachment column when the body is immovable, thereby the slider can have a smaller dimension in the up-down direction.

DETAILED DESCRIPTION

Figure 6:
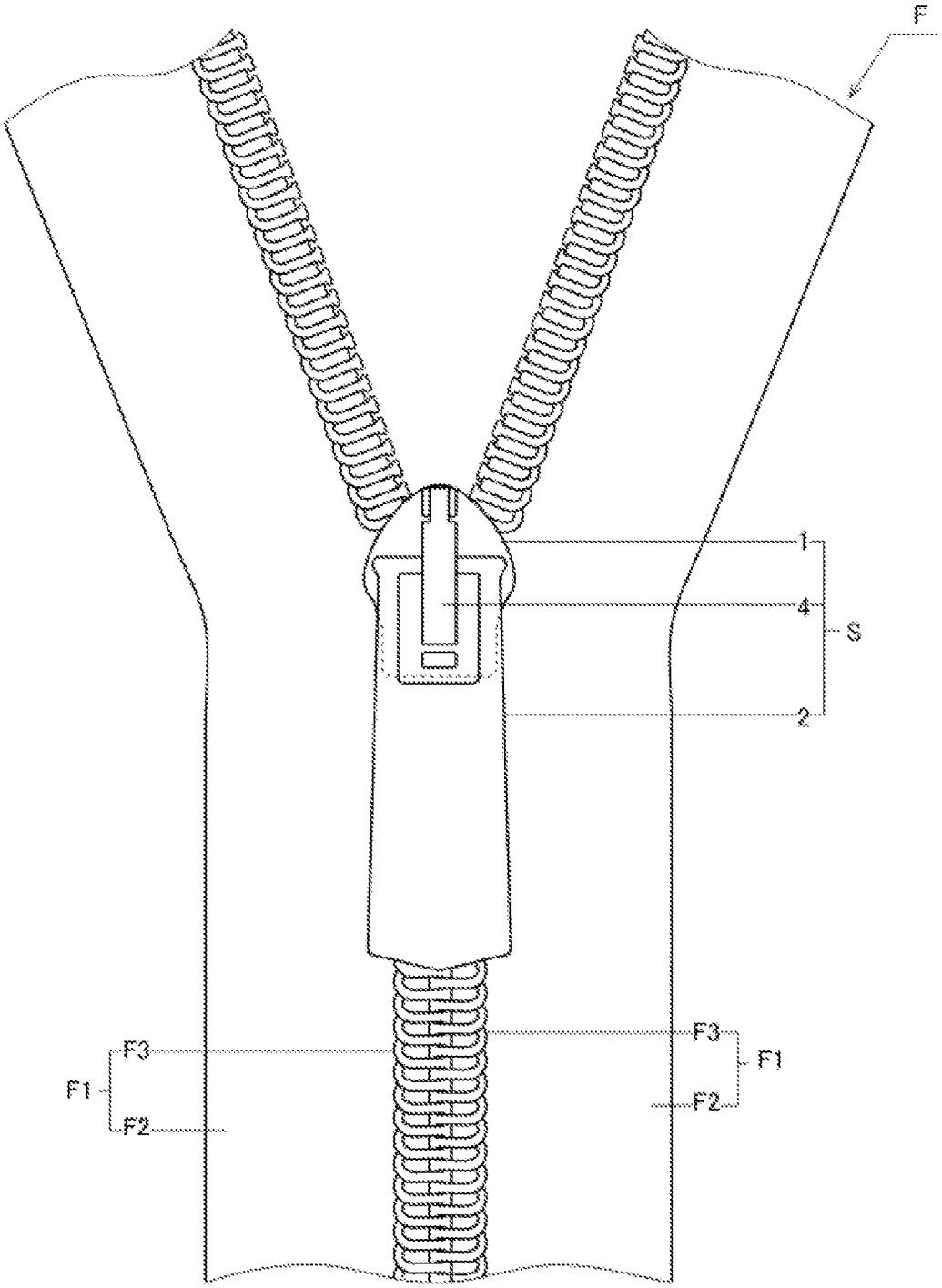
FIG. 6 is a plan view of a slide fastener comprising the slider of FIG. 1.

As shown in FIG. 6, a slide fastener F includes: a pair of fastener stringers F1, F1; and a slider S which opens and closes the pair of fastener stringers F1, F1.

The pair of fastener stringers F1, F1 includes: a pair of fastener tapes F2, F2 which are strip-shaped and face each other in a strip width direction; and a pair of element rows F3, F3, separately fixed to side edge portions, which face each other, of the pair of fastener tapes F2, F2. As in the shown example, the element row F3 is formed by bending a monofilament into a coil shape, and elements of one winding of the coil are continuous in a large number, or, although not shown, by fixing a large number of elements to the fastener tapes at intervals in an extending direction of the fastener tapes.

Hereinafter, directions are defined using three linear directions orthogonal to each other. A first linear direction is a direction in which the pair of fastener stringers F1 faces each other, in other words, a direction in which the pair of element rows F3, F3 faces each other, and is referred to as a left-right direction. The fastener stringer F1 (fastener tape F2) has a strip shape, and a strip width direction thereof is the left-right direction. The left-right direction refers to a left-right direction of FIG. 6.

A second linear direction is a longitudinal direction of the pair of fastener stringers F1, in other words, an extending direction of the strip-shaped fastener stringer F1, and is referred to as a longitudinal direction or a front-rear direction. A front direction is a direction in which the slider S is moved when the pair of fastener stringers F1 is closed (when the pair of element rows F3, F3 is engaged with each other). A rear direction is a direction in which the slider S is moved when the pair of fastener stringers F1 is opened (when the pair of element rows F3, F3 is separated). A front direction is an upward direction in FIG. 6, and a rear direction is a downward direction in FIG. 6.

A third linear direction is a thickness direction of the fastener stringer F1, in other words, a thickness direction of the fastener tape F2 and the element row F3, and is referred to as an up-down direction. An up direction is a direction facing the front of a direction orthogonal to a paper surface of FIG. 6. A down direction is a direction facing the back of the direction orthogonal to the paper surface of FIG. 6.

The slider S according to the first embodiment of the present disclosure, as shown in FIG. 6, includes: a body 1, which can open and close the pair of fastener stringers F1; a pull-tab 2, which is disposed on the body 1 and can be rotated back and forth; a control claw 3, which is placed on the body 1 and controls the body 1 to be movable and immovable in accordance with a mode of the pull-tab 2; and a cover 4, which covers the control claw 3 and connects the pull-tab 2 and the control claw 3 to the body 1, the cover 4 being swingable in the up-down direction. The slider S according to the first embodiment is configured with four components including the body 1, the pull-tab 2, the control claw 3, and the cover 4, which are separate components. As for the pull-tab 2, to rotate refers to a movement when the pull-tab 2 is operated to rotate back and forth when the pair of fastener stringers F1, F1 are opened and closed by the slider S. Hereinafter, each component will be described with reference to the slider S in a state in which the control claw 3 controls the body 1 to be immovable.

Figure 1:
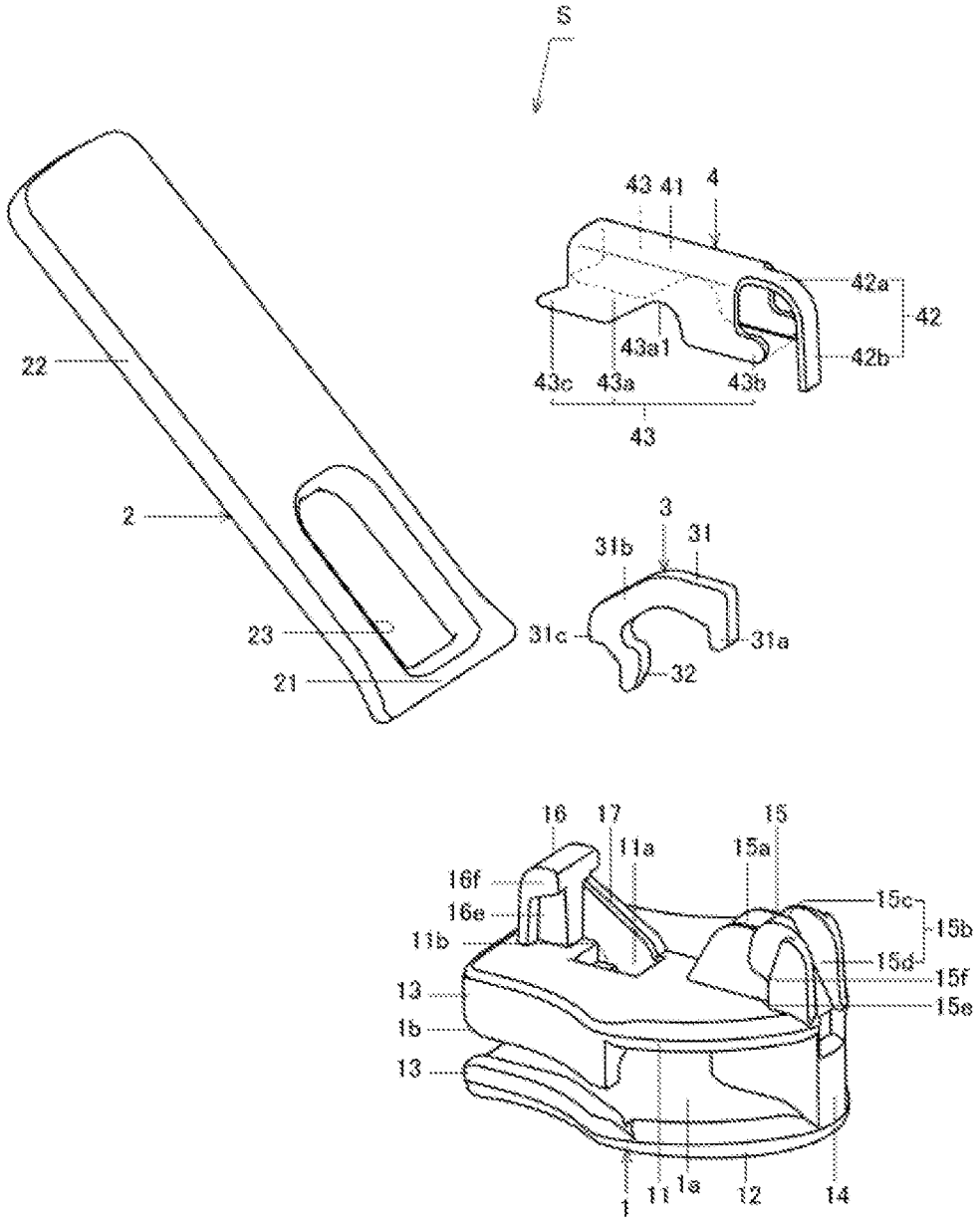
FIG. 1 is a perspective view showing a disassembled state of a slider according to a first embodiment of the present disclosure.
Figure 2:
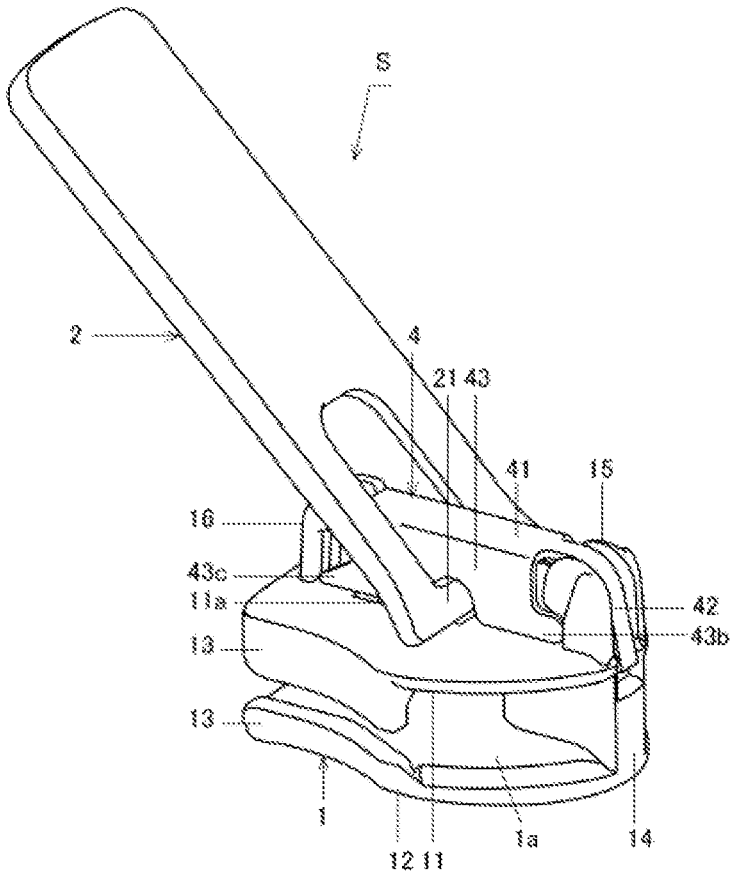
FIG. 2 is a perspective view showing an assembled state of the slider of FIG. 1.
Figure 3:
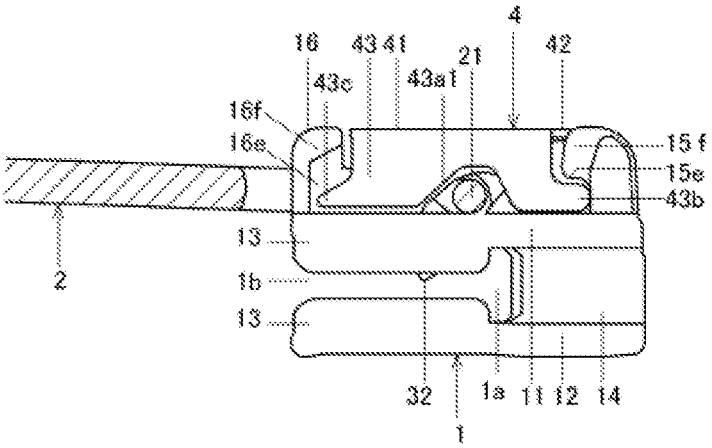
FIG. 3 is a side view of the slider of FIG. 1.

As shown in FIG. 1, the pull-tab 2 extends in a radial direction during the rotation, and includes a shaft portion 21 located at one end portion in the radial direction and a grip portion 22 located at the other end portion in the radial direction, which is used for gripping the pull-tab 2. More specifically, the pull-tab 2 includes a through hole 23 which passes through the cover 4 on one radial direction side. A portion on the other radial direction side with respect to the through hole 23 is the grip portion 22, and a portion among a frame portion which forms the through hole 23 and facing the grip portion 22 in the radial direction is the shaft portion 21. The shaft portion 21 is disposed above the body 1, and the control claw 3 is disposed above the shaft portion 21.

The control claw 3 includes a pushed-up portion 31 which extends in the front-rear direction on an upper side of the shaft portion 21 and is pushed up by the shaft portion 21, and a claw portion 32 extending downward from a rear portion of the pushed-up portion 31. The control claw 3 includes the claw portion 32 in front of a rear end of the pushed-up portion 31, and therefore a rear end portion 31*c* of the pushed-up portion 31 protrudes rearward beyond the claw portion 32.

The cover 4 includes an upper plate portion 41 facing an upper surface of the body 1, a plate spring portion 42 extending downward from a front end of the upper plate portion 41, and a pair of lateral plate portions 43, 43 extending downward from left and right ends of the upper plate portion 41. The cover 4 is formed by bending a metal plate by press processing. Thickness of the cover 4 (the lateral plate portion 43) is thinner than left-right direction thickness of the control claw 3. Details of the cover 4 will be described below.

The body 1 is used for engaging and disengaging elements. As shown in FIGS. 1 to 5, the body 1, as space portions, includes: an element path 1*a*, which penetrates in the front-rear direction on front and rear surfaces of the body 1 and through which the pair of element rows passes; and a tape groove 1*b*, which penetrates in the front-rear direction on left and right side surfaces of the body 1 and through which the pair of fastener tapes passes.

The element path 1*a* is a space portion whose front portion is partitioned into left and right parts. In other words, a front portion of the element path 1*a* is branched to the left and the right to form two branch paths, and a rear portion of the element path 1*a* is a rearward single path to which the two branch paths join.

In order to form the element path 1*a* and the tape groove 1*b*, the body 1 includes: an upper wing plate 11 covering an upper side of the element path 1*a*; a lower wing plate 12 which faces the upper wing plate 11 from below with an interval therebetween and covers a lower side of the element path 1*a*; flanges 13, 13 which protrude upward or downward so as to narrow the up-down interval between the upper wing plate 11 and the lower wing plate 12 and protrude from left and right end portions of at least one of the upper wing plate 11 and the lower wing plate 12 (in the shown example, four flanges 13 protrude from left and right end portions of both wing plates); a column 14 which connects front portions of the upper wing plate 11 and the lower wing plate 12 and connects the upper wing plate 11 and the lower wing plate 12 at a left-right direction intermediate portion, the column 14 being sandwiched between the pair of element rows F3, F3; and a front attachment column 15 and a rear attachment column 16 to which the cover 4 is attached, the front attachment column 15 and rear attachment column 16 protruding upward from the front and rear of an upper surface of the upper wing plate 11 from the left-right direction intermediate portion.

Each of the upper wing plate 11 and the lower wing plate 12 is a plate whose thickness direction is the up-down direction. The upper wing plate 11 includes a claw hole 11*a* between the front attachment column 15 and the rear attachment column 16 at a position closer to the rear attachment column 16 to allow the claw portion 32 to enter the element path 1*a*. The claw hole 11*a* penetrates the upper wing plate 11 in the up-down direction, which is the thickness direction thereof. The upper wing plate 11 includes a placement portion 11*b* on which the rear end portion 31*c* of the pushed-up portion 31 of the control claw 3 is placed between the front attachment column 15 and the rear attachment column 16 and adjacent to a rear side with respect to the claw hole 11*a*. The placement portion 11*b* is formed in a stepped shape which is recessed than portions in the vicinity thereof except the claw hole 11*a*. When the rear end portion 31*c* of the pushed-up portion 31 is placed on the placement portion 11*b*, the claw portion 32 protrudes from the claw hole 11*a* into the element path 1*a*. Therefore, a recessed portion degree (position in the up-down direction) of the placement portion 11*b* determines a maximum value of a protruding length of the claw portion 32 that protrudes the element path 1*a* from the claw hole 11*a*.

In addition to the upper wing plate 11, the lower wing plate 12, the flanges 13, the column 14, the front attachment column 15, and the rear attachment column 16, the body 1 includes an inner plate 17 protruding from the upper surface of the upper wing plate 11 between the front attachment column 15 and the rear attachment column 16 and on a front side with respect to the rear attachment column 16. More specifically, the inner plate 17 protrudes forward from the rear attachment column 16 on a lateral side of the claw hole 11*a* and the placement portion 11*b*, and is disposed on an inner side of the pair of lateral plate portions 43, 43 of the cover 4 along one lateral plate portion 43.

The body 1 positions the control claw 3 in the front-rear direction and the left-right direction between the front attachment column 15 and the rear attachment column 16 and accommodates the control claw 3 in a manner that allows the control claw 3 to swing in the up-down direction. In order to position the control claw 3 so that a front portion of the control claw 3 serving as a center portion of the swing, the body 1 and the control claw 3 include, at their front portions, a recessed portion 15*a* and a protruding portion 31*a* for the swing which engage with each other in the up-down direction.

The recessed portion 15*a* for the swing is formed on an upper surface of the front attachment column 15. More specifically, the front attachment column 15 includes the recessed portion 15*a* which is recessed downward in an intermediate portion of the upper surface thereof in the left-right direction. The protruding portion 31*a* for the swing is formed at a front end portion of the pushed-up portion 31 of the control claw 3. More specifically, the pushed-up portion 31 of the control claw 3 includes a pushed-up portion body 31*b* extending in the front-rear direction, and the protruding portion 31*a* for the swing extending downward from a front end portion of the pushed-up portion body 31*b*.

In a side view, the pushed-up portion body 31*b* has an arc shape, and a center of the arc shape is located below the pushed-up portion body.

The body 1 positions the plate spring portion 42 in the front-rear direction and the left-right direction so that the plate spring portion 42 extends along a front surface of the front attachment column 15, and accommodates the plate spring portion 42 therein. Therefore, the body 1 and the plate spring portion 42 have the following configurations.

The plate spring portion 42 includes a first spring piece portion 42*a* extending forward from the front end of the upper plate portion 41, and a second spring piece portion 42*b* extending downward from a front end of the first spring piece portion 42*a*.

The front attachment column 15 of the body 1 includes a recessed portion 15*b* for the plate spring portion extending from the upper surface to a front surface of the front attachment column 15 at an intermediate portion of the front attachment column 15 in the left-right direction. The plate spring portion recessed portion 15*b* includes a first recessed portion 15*c* which accommodates the first spring piece portion 42*a* and a second recessed portion 15*d* which accommodates the second spring piece portion. The second recessed portion 15*d* is formed over the front surface of the front attachment column 15 and the upper surface of the upper wing plate 11. The first recessed portion 15*c* has a depth equal to or less than a thickness of the first spring piece portion 42*a* of the plate spring portion 42, so that an upper surface of the cover 4 is substantially at the same height (more specifically, the same height or lower) with respect to the upper surface of the front attachment column 15.

A configuration in which the cover 4 is swingably attached to the body 1 is as follows.

The lateral plate portion 43 of the cover 4 includes a lateral plate body portion 43*a* extending downward from left and right ends of the upper plate portion 41, a front protruding piece portion 43*b* protruding forward with respect to a lower portion of the lateral plate body portion 43*a*, and a rear protruding piece portion 43*c* protruding rearward with respect to the lateral plate body portion 43*a*.

The front protruding piece portion 43*b* serves as a center portion when the cover 4 swings, and the rear protruding piece portion 43*c* serves as a displacement portion when the cover 4 swings. Therefore, in the cover 4, a front portion of the lateral plate portion 43 serves as a swing center portion and a rear portion of the lateral plate portion 43 serves as a displacement portion that displaces in the up-down direction due to the swing. When a rear portion of the cover 4 is displaced upward, the plate spring portion 42 is elastically deformed and bent, and a large restoring force which pushes back the rear portion of the cover 4 together with the control claw 3 downward is generated.

Each of portions of the pair of lateral plate body portions 43*a*, 43*a* which face lateral sides includes a through hole 43*a*1 which penetrates in the left-right direction and opens downward. The through hole 43*a*1 is a hole which the shaft portion 21 of the pull-tab 2 passes through and rotatably supports the pull-tab 2.

In the body 1, front accommodating portions 15*e* which accommodate the left and right front protruding piece portions 43*b* in a manner that does not allow vertical displacement are provided at lower portions of left and right side surfaces of the front attachment column 15, and rear accommodating portions 16*e* which accommodate the rear protruding piece portion 43*c* in a manner that allows vertical displacement are provided at lower portions of left and right side surfaces of the rear attachment column 16.

The front accommodating portion 15*e* is recessed on the side surface of the front attachment column 15 and opens rearward. An up-down dimension of the front accommodating portion 15*e* is slightly longer than an up-down dimension of the front protruding piece portion 43*b*. A portion of the side surface of the front attachment column 15 which is disposed above the front accommodating portion 15*e* is a front protruding portion 15*f* protruding in a stepped shape with respect to the front accommodating portion 15*e*. The front protruding portion 15*f* makes the front protruding piece portion 43*b* accommodated in the front accommodating portion 15*e* unable to displace upward. The rear accommodating portion 16*e* is recessed in the side surface of the rear attachment column 16 and opens forward. An up-down dimension of the rear accommodating portion 16*e* is sufficiently longer than an up-down dimension of the rear protruding piece portion 43*c*. A portion of the side surface of the rear attachment column 16 which is disposed above the rear accommodating portion 16*e* is a rear protruding portion 16*f* protruding in a stepped shape with respect to the rear accommodating portion 16*e*. The rear protruding portion 16*f* defines an upper limit position in a movement range of the rear protruding piece portion 43*c* which can displace in the up-down direction.

In the slider S according to the first embodiment described above, as shown in FIG. 4(A), the upper plate portion 41 of the cover 4 is in contact with the control claw 3 in the up-down direction when the shaft portion 21 of the pull-tab 2 is placed on the upper surface of the upper wing plate 11, and a lower end portion of the plate spring portion 42 is in contact with a front surface of the body 1, so that the plate spring portion 42 is slightly bent. Due to a restoring force of the plate spring portion 42, the upper plate portion 41 of the cover 4 pushes the control claw 3 downward, and the claw portion 32 deeply enters the element path 1*a*. A tip portion (lower end portion) of the claw portion 32 is fitted between adjacent elements of one element row. A front surface of an upper portion of the claw portion 32 contacts a front surface of the claw hole 11*a*, and the rear end portion 31*c* of the pushed-up portion 31 is placed on the placement portion 11*b*. Therefore, the slider S according to the first embodiment becomes immovable. In this way, the slider S according to the first embodiment becomes immovable (stopped) by its own force (restoring force of the cover 4). At this time, if the upper plate portion 41 of the cover 4 restricts upward movement of the control claw 3 due to the restoring force of the plate spring portion 42, the upper plate portion 41 of the cover 4 may not be in contact with (adjacent to) the control claw 3.

Figure 4A:
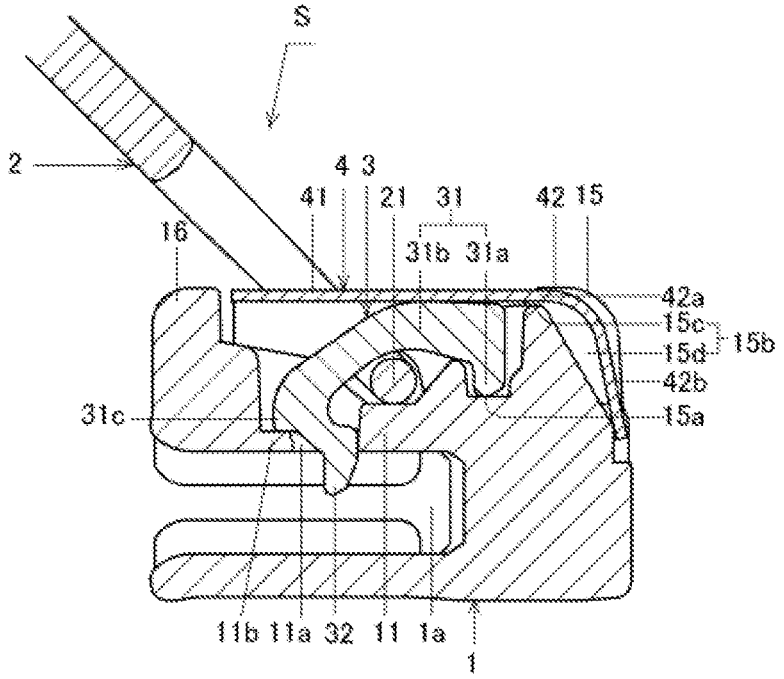
FIG. 4A is a cross-sectional view of the slider of FIG. 1 showing a state in which a control claw enters an element path.
Figure 4B:
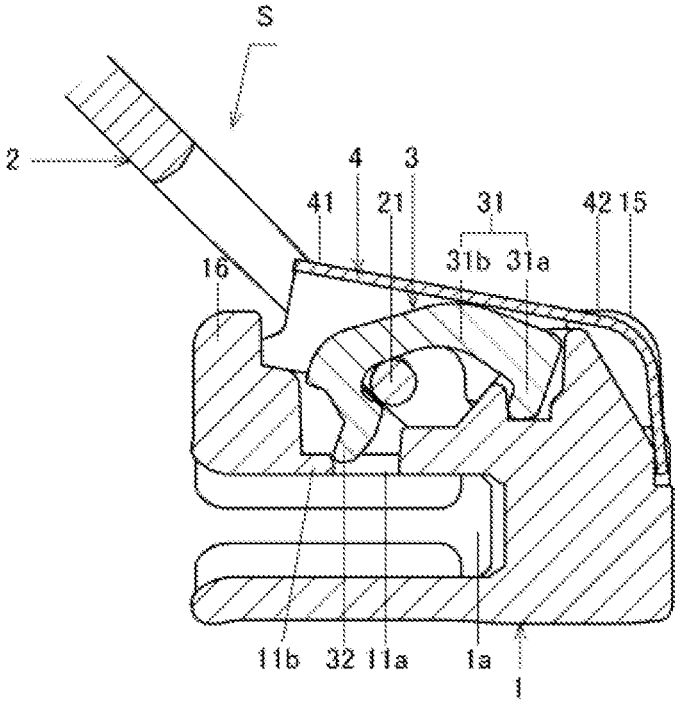
FIG. 4B is a cross-sectional view of the slider of FIG. 1 showing a state in which the control claw of FIG. 4A is out of the element path.
Figure 5:
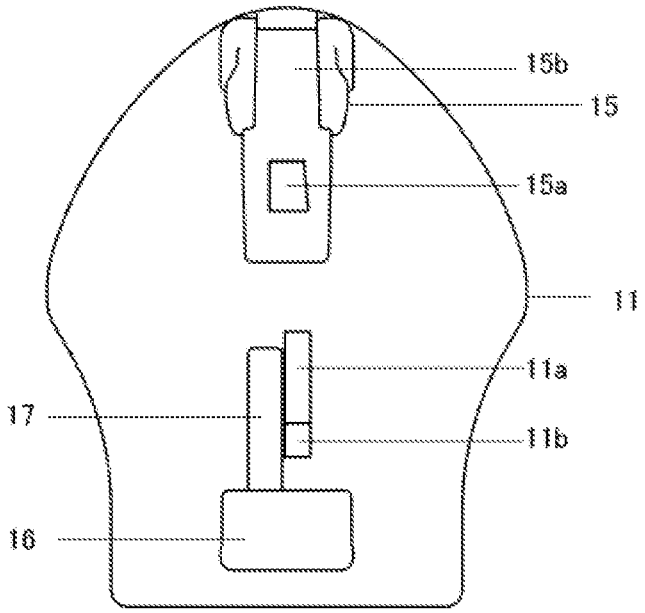
FIG. 5 is a plan view of a body of the slider of FIG. 1.

In the slider S according to the first embodiment, as shown in FIG. 4(B), when the shaft portion 21 of the pull-tab 2 pushes up the control claw 3 and moves away above the upper surface of the upper wing plate 11, the control claw 3 contacts the upper plate portion 41 of the cover 4, and lifts the cover 4 upward with the front portion of the lateral plate portion 43 serving as a center portion of the swing. At this time, the plate spring portion 42 is greatly bent, and a large restoring force is generated in the plate spring portion 42. The restoring force tends to push the cover 4 downward together with the control claw 3. When the shaft portion 21 of the pull-tab 2 pushes up the control claw 3, the claw portion 32 rises and the front surface of the upper portion of the claw portion 32 moves away from the front surface of the claw hole 11*a*, and the rear end portion 31*c* of the pushed-up portion 31 moves away from the placement portion 11*b*. At this time, as compared with a case where the shaft portion 21 is placed on the upper surface of the upper wing plate 11, the protruding length entering the element path 1*a* is shortened, and in the shown example, the protruding length is zero. In this case, the tip portion (lower portion) of the claw portion 32 comes out from space between adjacent elements of the one element row, and the slider S according to the first embodiment becomes movable. In this way, the control claw 3 controls movement of the slider S (body 1) by changing the protruding length of the claw portion 32 in accordance with an up-down position of the shaft portion 21.

The slider S according to the first embodiment described above has the following effects.

The slider S according to the first embodiment is configured with four components, since the control claw 3 and the cover 4 are separate components and the plate spring portion 42 is a portion of the cover 4, the number of components is smaller than that of a slider in which the control claw, the cover, and the plate spring are separate components (the slider disclosed in Patent Literature 2). In the slider in which the control claw, the cover, and the plate spring are separate components (the slider disclosed in Patent Literature 2), the up-down direction dimension is required to enable the cover and plate spring to overlap vertically. As for the slider S according to the first embodiment, the plate spring portion 42, which is a portion of the cover 4, extends along the upper surface and the front surface of the front attachment column 15, so it is not necessary to overlap the plate spring as a separate component below the cover, and the up-down direction dimension can be reduced.

In the slider S according to the first embodiment, the control claw 3 and the cover 4 are separate components, so rigidity of the control claw 3 and thickness of the cover 4 are irrelevant as compared with a slider in which the control claw 3 is a portion of the cover 4 (the slider disclosed in Patent Literature 1). Moreover, since left-right direction thickness of the control claw 3 is thicker than the thickness of the lateral plate portion 43 of the cover 4, the rigidity of the control claw 3 is higher than that of the cover 4, so that the claw portion 32 of the control claw 3 is hard to break.

In the slider S according to the first embodiment, when the body 1 is immovable, in other words, when the pull-tab 2 is not operated and the tip portion of the claw portion 32 is fitted between the adjacent elements of the one element row, the control claw 3 and the cover 4 are in contact with each other vertically, so that the up-down direction dimension can be further reduced.

In the slider S according to the first embodiment, since the upper surface of the cover 4 is substantially at the same height as the upper surface of the front attachment column, the up-down direction dimension can be further reduced.

The present disclosure is not limited to the above-described embodiment, and modifications can be made without departing from the scope thereof.

REFERENCE SIGNS LIST

F Slide fastener
F1 Fastener stringer
F2 Fastener tape
F3 Element row
S Slider
1 Body
1*a* Element path
1*b* Tape groove
11 Upper wing plate
11*a* Claw hole
11*b* Placement portion
12 Lower wing plate
13 Flange
14 Column
15 Front attachment column
15*a* Swinging recessed portion
15*b* Plate spring portion recessed portion
15*c* First recessed portion
15*d* Second recessed portion
15*e* Front accommodating portion
15*f* Front protruding portion
16 Rear attachment column
16*e* Rear accommodating portion
16*f* Rear protruding portion
17 Inner plate
2 Pull-tab
21 Shaft portion
22 Grip portion
23 Through hole
3 Control claw
31 Pushed-up portion
31*a* Protruding portion
31*b* Pushed-up portion body
31*c* Rear end portion
32 Claw portion
4 Cover
41 Upper plate portion
42 Plate spring portion
42*a* First spring piece portion
42*b* Second spring piece portion
43 Lateral plate portion
43*a* Lateral plate body portion
43*a*1 Through hole
43*b* Front protruding piece portion
43*c* Rear protruding piece portion

The invention claimed is:

1. A slider for a slide fastener, comprising:

a body, in which an element path penetrating in a front-rear direction and a claw hole communicating upward with respect to the element path are formed, wherein a front attachment column and a rear attachment column protrude from an upper surface of an upper wing plate covering an upper side of the element path;

a pull-tab, which is rotatable in the front-rear direction, and in which a shaft portion serving as a center of the rotation is disposed on the upper wing plate;

a control claw placed on the shaft portion between the front attachment column and the rear attachment column and configured to control the body to be movable and immovable, wherein a protrusion length of a claw portion that enters the element path from the claw hole changes depending on an up-down position of the shaft portion so as to control movement of the body; and a cover, having an upper plate portion and a lateral plate portion which cover the control claw from an upper side and a lateral side, and attached to the front attachment column and the rear attachment column so as to be swingable in an up-down direction, wherein the upper plate portion comes in contact with the control claw and pushes the control claw downward due to a restoring force of a plate spring portion extending from a front end of the upper plate portion along a front surface of the front attachment column;

wherein the body, the pull-tab, the control claw, and the cover are separate components.

2. The slider for the slide fastener according to claim 1, wherein when the body is movable, the control claw and the cover are in contact with each other in the up-down direction.

3. The slider for the slide fastener according to claim 1, wherein the lateral plate portion of the cover includes a lateral plate body portion extending downward from left and right ends of the upper plate portion and a front protruding piece portion protruding forward with respect to a lower portion of the lateral plate body portion, and the front protruding piece portion serves as a center portion when the cover swings.

4. The slider for the slide fastener according to claim 1, wherein when the body is immovable, the control claw and the cover are in contact with each other in the up-down direction.

5. The slider for the slide fastener according to claim 1, wherein the plate spring portion includes a first spring piece portion extending forward from the front end of the upper plate portion, and a second spring piece portion extending downward from a front end of the first spring piece portion, a first recessed portion accommodating the first spring piece portion is provided in a center portion of an upper surface of the front attachment column in a left-right direction, and an upper surface of the cover is at a same height as or lower than the upper surface of the front attachment column when the body is immovable.

* * * * *